United States Patent [19]

Marx

[11] Patent Number: 4,628,293

[45] Date of Patent: Dec. 9, 1986

[54] SUB-MINIATURE FUSE

[75] Inventor: Werner Marx, Witten, Fed. Rep. of Germany

[73] Assignee: Wickmann Werke GmbH, Fed. Rep. of Germany

[21] Appl. No.: 708,532

[22] Filed: Mar. 5, 1985

[30] Foreign Application Priority Data

Mar. 10, 1984 [DE] Fed. Rep. of Germany ..... 3408854

[51] Int. Cl.[4] ..... H01H 85/52; H01H 85/62

[52] U.S. Cl. ..... 337/216; 337/232; 337/255; 337/260

[58] Field of Search ..... 337/216, 255, 260, 215, 337/252, 271, 251, 253, 254, 232, 234; 29/623; 219/517

[56] References Cited

U.S. PATENT DOCUMENTS

| | | | |
|---|---|---|---|
| 1,008,411 | 11/1911 | Hills | 219/517 |
| 3,123,696 | 3/1964 | McAlister | 337/251 |
| 3,253,244 | 5/1966 | Hoy et al. | 338/319 |
| 4,434,548 | 3/1984 | Beswick | 29/623 |
| 4,483,064 | 11/1984 | Bernstein | 29/623 |

*Primary Examiner*—Harold Broome

*Attorney, Agent, or Firm*—Banner, Birch, McKie & Beckett

[57] ABSTRACT

A sub-miniature fuse comprises a plastic base, and two conductors passing through the base and being bridged by a fuse wire soldered to the conductors. For obtaining a reliable fixture of the fuse wire to the conductors a fuse wire holder is formed on each of these conductors above the base and the connection between said holder and the fuse wire positioned in the latter is secured by melting on soft solder material. It is particularly advantageous to construct the holder by rolling up or bending over the upper end of each conductor.

5 Claims, 4 Drawing Figures

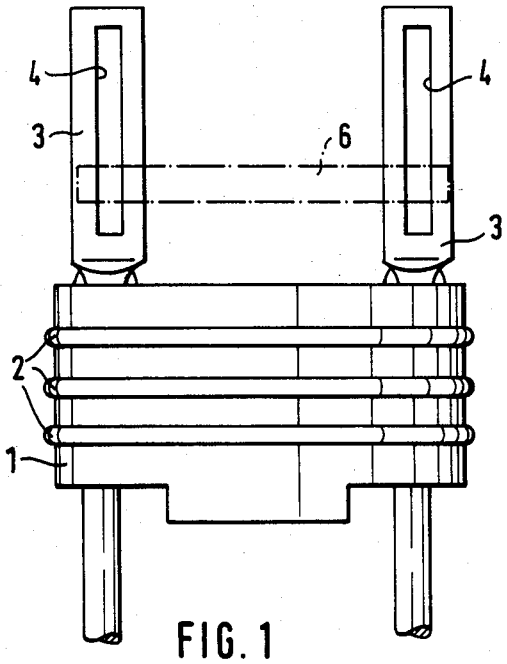
FIG. 1
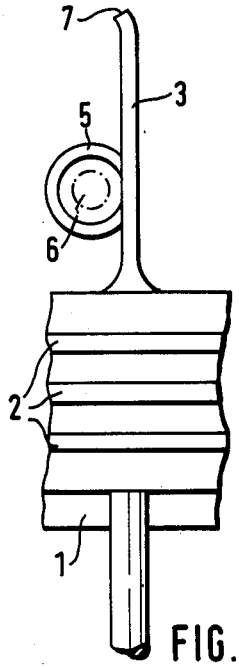
FIG. 2
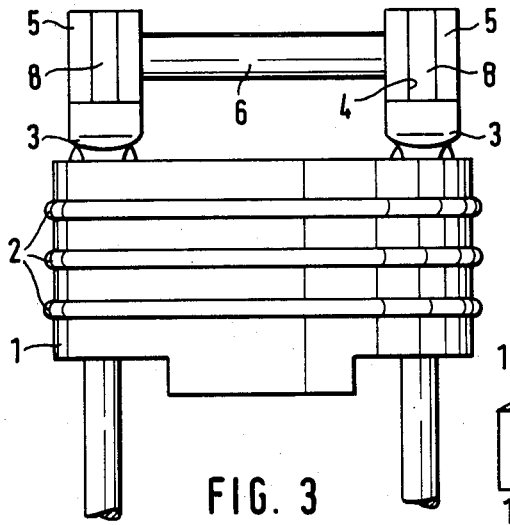
FIG. 3
FIG. 4
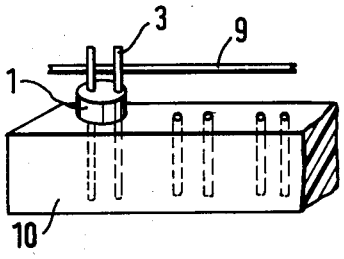

SUB-MINIATURE FUSE

BACKGROUND OF THE INVENTION

1. Field of the Invention

The present invention relates to a sub-miniature fuse of the type comprising a plastic base and two conductors passing through the base, which conductors are bridged by a fuse wire soldered thereto.

The invention is suitable for all fuses, in which a fuse wire is to be fixed in a transverse position thereto, as well as for any other electrical components, in the case of which some other conductor is to be fixed reliably to a first conductor which is at right angles thereto. As the invention is used in preferred manner for sub-miniature fuses of the aforementioned type, it will be explained hereinafter with sole reference to such fuses.

2. Prior Art

In the hitherto known manufacture of sub-miniature fuses, the fuse wire is soft soldered to the conductors in the vicinity of the ends of the pin-like conductors above the base. Particularly when using fuse wires made from very thin wires soldering is performed manually, in order to ensure a reliable and secure connection between the conductors and the fuse wire.

However, even if this soldering process is performed with maximum care, the attainable fixing action cannot withstand all stresses to which the sub-miniature fuse is exposed during further steps of manufacture and particularly during subsequent use.

When sub-miniature fuses are soldered into printed circuit boards, the transmitted heat can influence the soldering seam between the terminal pin and the fuse wire to such an extent that the soldering connection may even break.

OBJECTS OF THE INVENTION

It is therefore an essential object of the invention to ensure a reliable fixing of the fuse wire to the conductors. In connection with the desired improvement of fixing, it is a further object of the invention to take account both of the extremely small dimensions of the fuse wire and conductors and the fact that the fuses of the present type are a typical mass-produced article, in which even slight extra expenditure can give rise to an overall drastic increase in manufacturing costs.

SUMMARY OF THE INVENTION

In a sub-miniature fuse comprising a plastic base, two conductors penetrating this base at the top and bottom thereof to extend upwardly and downwardly beyond the base, and a fuse wire bridging the conductors by being solder-secured thereto, these objects are achieved according to the invention in that a holder for the fuse wire is formed on each conductor on its extension above the base and the connection between the holder and the fuse wire is strengthened by melting on soft solder material.

Thus, according to the invention, apart from soldering, the fuse wire is additionally secured by holding or receptacle means, which engage the fuse wire. As a result, a mechanical or positive connection is formed between the fuse wire and each of the two conductors of the sub-miniature fuse before soft solder is applied to the joint additionally. It is sufficient if the fuse wire is initially only held in or on the holder and is then finally fixed by soft soldering. Accordingly there is a large number of possibilities for the construction of the holder and for performing its holding function.

Preferably, however, the holder may be formed by rolling up or bending over the upper end of the conductor. The fuse wire can be introduced into this loop-shaped holder either by subsequently drawing or hanging in, as a function of whether the holder wholly or only partly embraces the fuse wire, or the fuse wire is placed on the conductor before the latter is rolled up or bent over, so that following the shaping of the holder, the fuse wire is already located therein.

Expediently, the upper end of the conductor is shaped flat, i.e. it is flattened. Preferably, recesses or notches are provided in the holder. The conductors, whose cross-section is normally circular, are made flat for attaching the fuse wire, so that the holder embraces the fuse wire with a planar portion. The notches are very important for the soldering quality, because the tin solder in this way adheres to the fuse wire not only on either side of the holder, but also reaches the fuse wire through the notch and produces additional bridges between the fuse wire and the holder and/or conductor. In addition, the tin solder adheres much better to the resulting uneven or fissured surface of the holder than in the case of a smooth-surfaced holder construction. This holder shape also leads to a certain capillary action when applying the liquid soft solder, which further improves the strength of the soldered joint.

It has proved most advantageous to form an elongated cutout on the upper flattened end of the conductor in order to obtain the aforementioned results.

According to the invention, a particularly economical method for the manufacture of the subminiature fuse comprises the steps that a plurality of bases with inserted conductors on whose upper ends the holders lateron are prepared are aligned side by side in a linear row, that a continuous fuse wire filament is applied in the stretched position and at a predetermined height with respect to the bases to the upper ends of the conductors essentially perpendicular thereto, that one holder, each is formed by rolling up or bending over the upper ends of the conductors for embracing and holding the fuse wire filament, that soft soldering material is applied to the holder and the fuse wire filament in this area and that the connecting pieces between the thus formed fuse wires of neighbouring fuses are removed. If necessary, the fixing area is then reground, cleaned and polished, after which the cap is placed and fixed onto the base.

The preparation for the shaping of the holder at the upper end of each conductor comprises, depending on the desired shape of the holder, for example a tilting action, namely a slight bending over of the conductor end if the holder is to be produced by rolling up. The preparatory work prior to the fixing of the fuse wire filament also includes the flat shaping and producing of an elongated cutout in the conductor above the base. It is important to perform a simultaneous treatment of a plurality of units formed by bases with inserted conductors by arranging the bases side by side in an aligned manner in a device. The fuse wire filament running simultaneously over the entire line of conductors is embraced and held by the holder in a combined operation during the production of the holder by rolling up or bending over the upper ends of the conductors, so that in a further operation the melting on of the tin solder can take place, followed by the severing of the thus formed fuse wire from the common filament, whereupon any remaining work can be performed.

Thus, a significant improvement to the quality of fixing the fuse wire to the conductors of the sub-miniature fuse is achieved without any significant extra effort and expenditure. In fact, savings can result from considerably reducing the amount of waste material. It should be noted that, in particular, the advantages resulting from the construction according to the invention and the greater reliability of the joint between the fuse wire and the conductors when using the sub-miniature fuse are very important.

BRIEF DESCRIPTION OF THE DRAWINGS

Other and further objects of the present invention will be apparent from the following description and claims and are illustrated in the accompanying drawings, which by way of illustration schematically show preferred embodiments of the present invention and the principles thereof and what now are considered to be the best modes contemplated for applying these principles. Other embodiments of the invention embodying the same or equivalent principles may be used and structural changes may be made as desired by those skilled in the art without departing from the present invention and the scope of the appended claims.

In the drawings:

FIG. 1 is a front view of a sub-miniature fuse base in the state of manufacture prior to rolling up conductors passing through the base;

FIG. 2 is a side view of the embodiment shown in FIG. 1 showing the next step of production;

FIG. 3 is a front view of the base after attaching a fuse wire to the conductors;

FIG. 4 is a diagrammatic view of a device used in the production of the sub-miniature fuse.

DETAILED DESCRIPTION OF THE EMBODIMENTS

A plastic base 1 having a circular cross-section is peripherally provided with ribs 2 along its periphery for attaching a known per se and thus not shown plastic cap, as well as with two pin-shaped conductors 3 passing through said base to extend beyond and below the latter and anchored therein. The contact or terminal pins of said conductors, e.g. for connecting these conductors 3 have a flat shape above the base 1 and, as shown, have elongated cutouts 4. These flat portions of the conductors 3 are rolled up incorporating a fuse wire 6 represented in dash-dotted lines, and forming a holder 5 embracing the fuse wire 6 as illustrated in FIG. 2, following a tilting action at point 7. Thereafter tin solder 8 is applied and projecting fuse wire portions are severed, so that a final state according to FIG. 3 is obtained.

For a common processing of a plurality of units, comprising bases 1 and conductors 3, in the manner diagrammatically shown in FIG. 4, said units are arranged side by side in an aligned form in a device 10 shaped like a bar. If the conductors 3 have been flattened prior to their insertion in the bases 1, the treatment in the device 10 commences by applying a fuse wire filament 9 in a stretched position to all the conductors 3. The rolling up of conductors 3 tilted at point 7 is then carried out in such a way that, as shown in FIG. 2, the fuse wire 6 is engaged resp. embraced by the holder 5. Thereafter, the tin soft solder material is applied to the whole junction area between the holder 5 and the fuse wire 6, whereupon the fuse wires 6 are individualized, i.e. detached from the common filament and any work still necessary is carried out at the junction points, after which the not shown cap is placed on the base or socket 1 and attached thereto.

To illustrate the small size of the sub-miniature fuse, reference is made to its approximate dimensions in the following:

base diameter approx. 7 mm
conductor diameter approx. 0.6 mm
width of flattened conductor approx. 1.2 mm
conductor length above base prior to rolling up approx. 4.5 mm
internal diameter of holder approx. 1 mm.

It will be understood that the aforementioned dimensions solely relate to a single embodiment and that the invention is in no way limited thereto.

It should also be understood that the same size of the loop-like holder 5 can be used for fuse wire of different diameters, for the tin solder material 8 will fill the gap between the fuse wire 6 and the holder 5 in all cases of which material the necessary quantity will flow into holder 5 in order to fill the gap in each case. When fixing very thin wires 6 , as a result of the larger gap between the same and the holder 5, there is an even greater capillary action, i.e. the tin solder 8 is drawn into the loop-shaped holder 5. The holder 5 then provides a natural protection for the solder joint against any type of damage to the fixture, including direct mechanical action, especially during further manufacturing operations.

What is claimed is:

1. Electric sub-miniature fuse of the type comprising at least plastic base means defining an upper side and a lower side;

two electric conductor means passing through said base means to form upper and lower conductor extensions beyond said upper and said lower sides, respectively;

electric fuse wire means bridging said upper conductor extensions and having soldered connections therewith;

wherein each of said upper conductor extensions is formed with holder means for engagement with said fuse wire means, respectively, and defining the positions for said soldered connections at said upper conductor extensions, said holder means being formed by a deformation of each one of said upper conductor extensions, respective, said soldered connections being formed by soft solder melting material applied to said holder means and said fuse wire means for reinforcing said engagement of said fuse wire means by said holder means.

2. Sub-miniature fuse as claimed in claim 1, wherein said upper conductor extensions have a flat shape, respectively, and wherein said holder means are provided with recesses or notches.

3. Sub-miniature fuse as claimed in claim 4, wherein said flat-shaped upper conductor extensions each carry an elongated cutout.

4. Sub-miniature fuse as claimed in claim 1, wherein said deformation is formed by rolling up said upper conductor extensions.

5. Sub-miniature fuse as claimed in claim 1, wherein said deformation is formed by bending over said upper conductor extensions.

* * * * *